United States Patent [19]

Johansen

[11] Patent Number: 5,076,342

[45] Date of Patent: Dec. 31, 1991

[54] PROCEDURE AND APPARATUS FOR CHANGING OF CORE MASKS AT A CORE SETTING APPARATUS FOR AN AUTOMATIC CORE MAKING SYSTEM

[75] Inventor: Jan B. Johansen, Humlebaek, Denmark

[73] Assignee: Dansk Industri Syndikat A/S, Herley, Denmark

[21] Appl. No.: 525,033

[22] Filed: May 18, 1990

[30] Foreign Application Priority Data

May 18, 1989 [DK] Denmark ..... 2416/89

[51] Int. Cl.[5] ..... B22C 9/10; B22D 33/04

[52] U.S. Cl. ..... 164/137; 164/340

[58] Field of Search ..... 164/137, 340

[56] References Cited

U.S. PATENT DOCUMENTS

| | | | |
|---|---|---|---|
| 3,424,229 | 1/1969 | Gunnergaard-Poulsen | 164/137 X |
| 3,910,343 | 10/1975 | Popov et al. | 164/137 X |
| 4,008,748 | 2/1977 | Gunnergaard | 164/137 X |
| 4,079,774 | 3/1978 | Gunnergaard et al. . | |
| 4,590,982 | 5/1986 | Hunter . | |
| 4,615,374 | 10/1986 | Persson . | |
| 4,765,389 | 8/1988 | Knudsen | 164/137 X |
| 4,848,440 | 7/1989 | Hunter | 164/340 X |

FOREIGN PATENT DOCUMENTS

| | | | |
|---|---|---|---|
| 58-20354 | 2/1983 | Japan | 164/340 |

*Primary Examiner*—J. Reed Batten, Jr.
*Attorney, Agent, or Firm*—Larson & Taylor

[57] ABSTRACT

A core mask is mounted on a rear plate which is designed to establish a vacuum or a pressure for holding the core or cores in the mask. A unit including a mask and rear plate is stored in a magazine near a core setting system. The unit is transferred from the magazine to the core setting system, where it is positioned and fastened so that it can be released while at the same time a fluid connection is established between the unit and the core setting system. The unit is removed after use from the core setting system by release of a lock and the unit is returned to the magazine.

10 Claims, 4 Drawing Sheets

Figure 1:
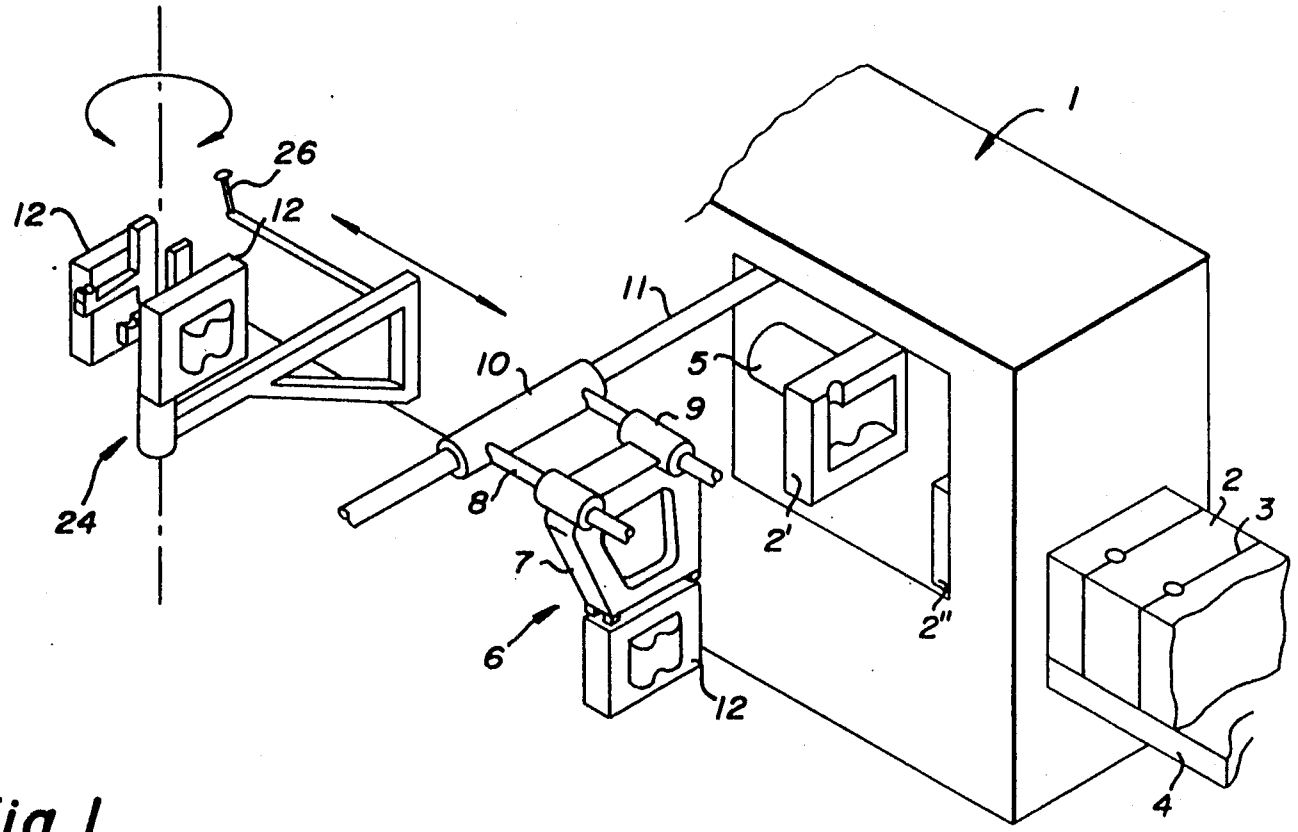

PROCEDURE AND APPARATUS FOR CHANGING OF CORE MASKS AT A CORE SETTING APPARATUS FOR AN AUTOMATIC CORE MAKING SYSTEM

The invention concerns a procedure and an apparatus for changing at a core setting apparatus for an automatic core making system where the core setting apparatus has been designed to move a core placed in a core mask into the mold impression in a previously made mold section from a position outside the conveying path of the mold sections.

Danish Patent Specification No. 144.847 a core setting apparatus is known, where the core setter comprises a bracket in a sliding suspension on guide bars, and which at the bottom is designed to accept a core mask. The core mask, which in the case of large molding systems can be a relatively heavy element, is manually guided to its position in the rear plate of the bracket and fastened to the latter by means of a suitable number of screwed connections. The work with positioning the core mask in the rear plate of the core setting apparatus can be heavy and difficult, calling for two operators who must be ready when pattern boards and core masks are to be changed at the molding system. At the high-speed automatic molding systems of the above nature the cycle time is thereby increased disproportionately.

With a handling apparatus of the kind described in Danish Patent Application No. 1683/83, the complicated and time consuming work in changing core masks has been eliminated, and the waiting time at core mask changes has been reduced to a minimum, while at the same time a fully automatic robot has been produced, which is designed independently to perform pattern board changes and core mask changes, and to function as a core setting apparatus during normal operation of the molding system. The handling robot described in Danish Application No. 1683/83 also assumes that core masks, pattern boards and loose cores are presented on pallets on a roller conveyor or similar, placed parallel to the conveying path of the mold sections. Furthermore, near the robot there must be a raising and lowering device for aligning the core masks with the retaining device of the robot. The known handling robot is very suitable for systems where the work involves frequent changes of patterns and core masks, but it represents a relatively expensive solution, which is unnecessary in cases where pattern changes are required rather infrequently.

At molding systems where relatively rare changes of pattern boards and core masks are required, and where few and light cores are involved, it is quite easy to work with manual setting of the core masks in a core setting apparatus of the nature described in the above Danish Patent Specification No. 144.847. On the other hand, this solution is unsatisfactory where changes are to be made to fairly heavy core masks at foundry jobs involving rather frequent pattern changes, and where loss of cycle time at the molding system is unacceptable.

The purpose of the invention is to provide a procedure and an apparatus, which in an economical way ensures a quick exchange in relation to the cycle time of relatively heavy core masks in core setting apparatus for automatic mold production systems.

This aim is achieved according to the invention by following a procedure of the nature mentioned in the introduction, characterized by the following operational steps:

a) the core mask is mounted on a rear plate, which is designed to be able to produce a vacuum or a pressure for securing the core or cores in the mask, b) the unit consisting of mask and rear plate is stored in a magazine placed near the core setting apparatus, c) the unit consisting of mask and rear plate is transferred from the magazine to the core setting apparatus, where it is positioned and retained so that it can be released while at the same time a fluid connection is established between the unit and the core setting apparatus so that a vacuum or a pressure can be applied to the core mask, and d) the unit is removed after use from the core setting apparatus by releasing the lock, and the unit is returned to the magazine, where it is kept for later use or removed manually in order to give room for a new unit.

By this procedure the advantage is obtained that the core mask can be mounted on the rear plate under convenient circumstances such as in a room outside the foundry. At this mounting procedure, which can be performed, for example while the core mask is placed horizontally at a suitable working height, there is time to work more accurately then when mounting on the spot, which will also be subject to time pressure. Some time before the planned pattern mask change, the unit or units are placed in the magazine, from where the unit can quickly at the desired moment be transferred to the core setting apparatus by a mechanized process, which can be controlled by one operator.

At a system for using the procedure a core setting apparatus is obtained, which is designed to be moved forwards and backwards in a plane at right angles to a conveying path for a number of consecutive mold sections with vertical dividing line as well as forwards and backwards in the direction of the conveying path. This system is characterized by the core setting apparatus being designed in a releasable manner to receive a unit consisting of core mask and rear plate, this unit being pushed against a well defined stop on the core setting apparatus, after which the locking function is activated when the core setting apparatus is situated in the position by the side of the row of mold sections, and that the rear plate is provided with connecting studs that engage automatically into corresponding studs on the core setting apparatus for establishing a fluid connection when the rear plate has been brought up against the said stop.

By dividing the core setting apparatus into an upper part, which in a way known per se is suspended slidingly in two bar guides positioned at right angles to each other in order to provide an L- or U-shaped moving pattern, and a rear plate designed to receive the core mask and to provide releasable coupling with the first part of the core setter, it is made possible to prepare change of core mask in due time before the core setting apparatus is in the position where change of core mask is possible. The change of core mask can in this way be made without time-consuming screw or bolt connections, and the core setting apparatus is immediately operative when core mask and rear plate are positioned on the core setting apparatus, the automatic coupling of the fluid connection between core setter and rear plate being established.

According to the invention the rear plate can be provided with contact plates and be designed to engage matching contact plates on the core setter, the contact plates of the rear plate being made to rest on top of the contact plates of the core setter.

By this design it is made possible to push the rear plate into the core setter with a single, rectilinear movement, the rear plate being lowered into position in the core setter with a similar, simple movement at right angles to the first mentioned movement when the contact plates of the core setter and the rear plate face each other.

The core setter has in a preferred design version at least one locking dowel with a conical point, designed to engage with a complementarily shaped conical hole in the rear plate. In this way the locking dowel fills a double function, the conical shape of dowel and hole ensuring a final alignment of the rear plate in the core setter, while at the same time the locking dowel can exert a pressure of a suitable magnitude for holding the rear plate firmly in position in the core setter even at the relatively great loads arising when the core are pressed in position in the mold sections.

In a preferred design version of a system according to the invention, a magazine is provided for storing the unit consisting of core mask and rear plate. According to the invention the magazine comprises at least two retaining devices designed to retain a rear plate by engaging locking studs on its rear side, whereby the retaining devices can be turned around a principally vertical axis and raised and lowered vertically while the rear plate is suspended in the locking studs.

In this way it is made possible to transport and handle the rear plates and to deliver these in required positions by translational movements of the magazine and by swinging around the vertical axis.

According to the invention the magazine can be slidingly suspended, and designed for accurate travel forwards and backwards parallel to the path of movement of the mold sections towards and away from the core setting apparatus. The movable suspension of the magazine in a direction parallel with the path of movement of the mold sections makes it possible for an operator to change rear plates in the core setter from a position at some distance from it.

According to the invention the magazine can be suspended on a guide bar fastened to the side of the molding system, which bar is positioned in the direction of movement of the mold sections. In this way a well-defined conveying path is obtained for the magazine, and the motion forwards or backwards can either be controlled manually or possibly be automatic by introducing a work cylinder between the mold system and the magazine.

At a preferred design version of the system according to the invention the retaining devices are designed as a frame, which via a lever mechanism can be turned between an upper and a lower position, whereby the contact plates of the rear plate are placed at a level respectively just above and just below the level defined by the contact plates of the core setting apparatus.

Thereby the rear plate can while suspended in the retaining studs be pushed into the core setter and by activation of the lever mechanism be lowered into position on the matching contact plates of the core setter apparatus, and by further turning of the handle be disengaged from the rear plate, after which the whole magazine can be returned to the position outside the core setting apparatus.

According to the invention the supporting plates can be connected to a yoke designed to turn freely around a vertical axis by release of a locking pawl which is movingly connected to the magazine frame, and designed to engage into a collar fastened to the yoke.

In this way it is made possible to use the magazine both for storing rear plates with core masks, which at a certain time are to be placed in the core setter, and to perform the mounting of new core masks in rear plates at various positions around the vertical axis, the magazine working according to the "round-about" principle.

The supporting frames and the linking mechanisms of the locking pawl can according to the invention be suitably coupled to the same control lever, whereby the movements of the supporting frames and the locking pawl are activated by placing the control lever in corresponding positions. In this way a mechanically simple solution is obtained while at the same time it is ensured that the functions are carried out separately.

Figure 2:
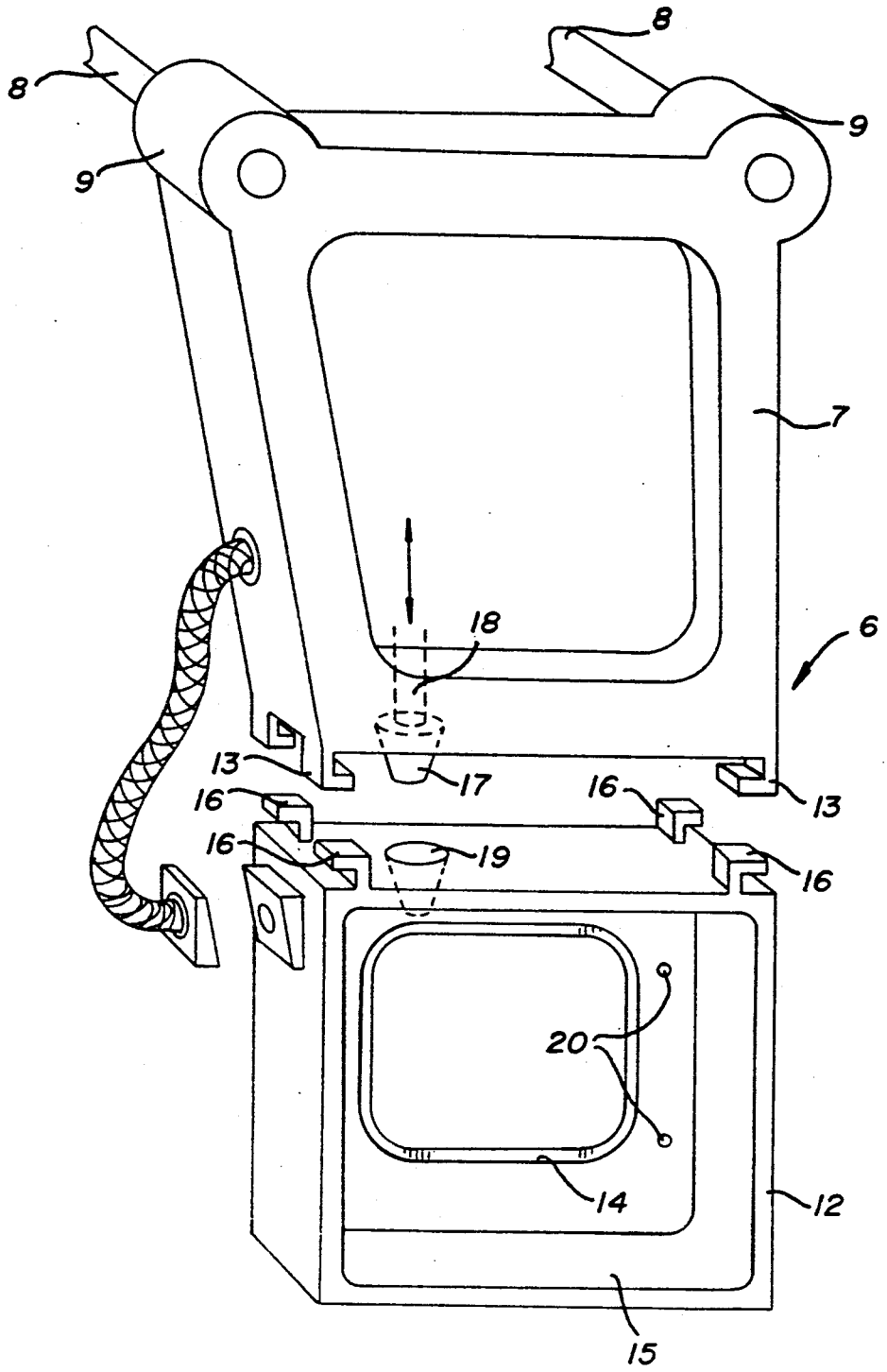

In the following the invention will be explained in detail with reference to the drawing, on which FIG. 1 schematically shows a system for operation while using the procedure according to the invention, FIG. 2 schematically shows a core setter with rear plate for the core mask, FIG. 3 in oblique drawing shows a handling magazine according to the invention, FIG. 4*a*–4*f* schematically show an operational sequence of the handling magazine.

The invention shall in the following be explained in more detail with reference to the drawing, on which FIG. 1 shows schematically a system for operation while using the procedure according to the invention, FIG. 2 shows a core setter with rear plate for mounting of a core mask, FIG. 3 seen from the front and partially in section shows a handling apparatus according to the invention, FIG. 4*a*–4*f* schematically show a sequence illustrating the mode of operation of the storage magazine according to the invention.

By the reference FIG. 1 in FIG. 1 a machine has been sketched for production of mold sections 2 with vertical dividing line 3. As indicated, the mold sections 2' just made are moved forward towards the rear mold section 2'' in the string of mold sections on the conveyor 4. The movement is produced by a sketched ejector piston 5.

When molds are to be made with set cores, a core shall be placed between two adjacent mold sections 2' and 2'', which in practice is done by placing a core in the mold impression of mold section 2'' at the position of mold sections indicated in FIG. 1.

The core is now moved into position by means of core setting apparatus generally denoted 6. The core setting apparatus consists of a core setter 7, which is slidingly suspended on two guide bars 8 via guide bushes 9. The guide bars 8 are fastened to another set of guide bushes 10 (of which only one is shown in the drawing), sliding on another set of guide bars 11. The guide bars 11 are placed at right angles to the direction of the path of the mold sections, whereas the bars 8 are placed parallel to the direction of movement of the mold sections. The core setter 7 can thereby be moved along a U-shaped path, i.e. translationally out and in from a position between the mold sections 2' and 2'' and the position shown in FIG. 1 outside the string of molds, as well as forwards and backwards in the direction of movement of the mold sections for delivering a core in to the mold impression of the rearmost mold section 2''. At the other extreme end outside the mold sections the core setter can be moved forward in the direction of the movement of the mold sections to a service position in front of the proper stand-by position of the core setter.

The lower part of the core setter 7 is designed to receive a unit 12 consisting of a core mask and a rear plate. The co-operation between the core setter 7 and the unit 12 is described in the following with reference to FIG. 2.

In FIG. 1 a magazine 24 is also sketched for storing of units 12 consisting of a rear plate and a core mask mounted in this. The magazine contains two units 12. The magazine can be moved forwards and backwards in the direction of movement of the mold sections by movement along a bar fastened to the side of the machine 1 by means of handle 26. In addition, the units 12 suspended in the magazine can be turned around a vertical axis, so that the units 12 can be swiveled to a position turned 180°. The design and mode of operation will be explained in the following with reference to FIG. 3.

In FIG. 2 the core setter 7 is suspended in the guide bars 8 via guide bushes 9. To the lower part of the core setter 7, coupling lugs 13 are fastened at the four corners. The unit 12 is shown in FIG. 2 without core mask, and therefore the rear plate 15 with gasket 14 for vacuum connection to the rear side of the core mask for securing this is visible in FIG. 2. At the top side of the rear plate there are coupling lugs 16 fastened at the corners. The lugs 16 are designed to rest on top of the lugs 13 on the bottom side of the core setter. Fastening of the rear plate is ensured by means of a cylinder-piston unit 18 fastened to the core setter 7, which unit has a conical piston 17 designed to engage with a complementary conical hole 19 in the top side of rear plate 15.

The core mask (not shown) is placed, in a way known per se. in the rear plate 15 by bolting to the screw holes 20, whereby the unit 12 is complete. The mounting of the core mask can take place outside the foundry. The unit 12 is placed on the handling magazine shown in more detail in fig. 3.

Figure 3:
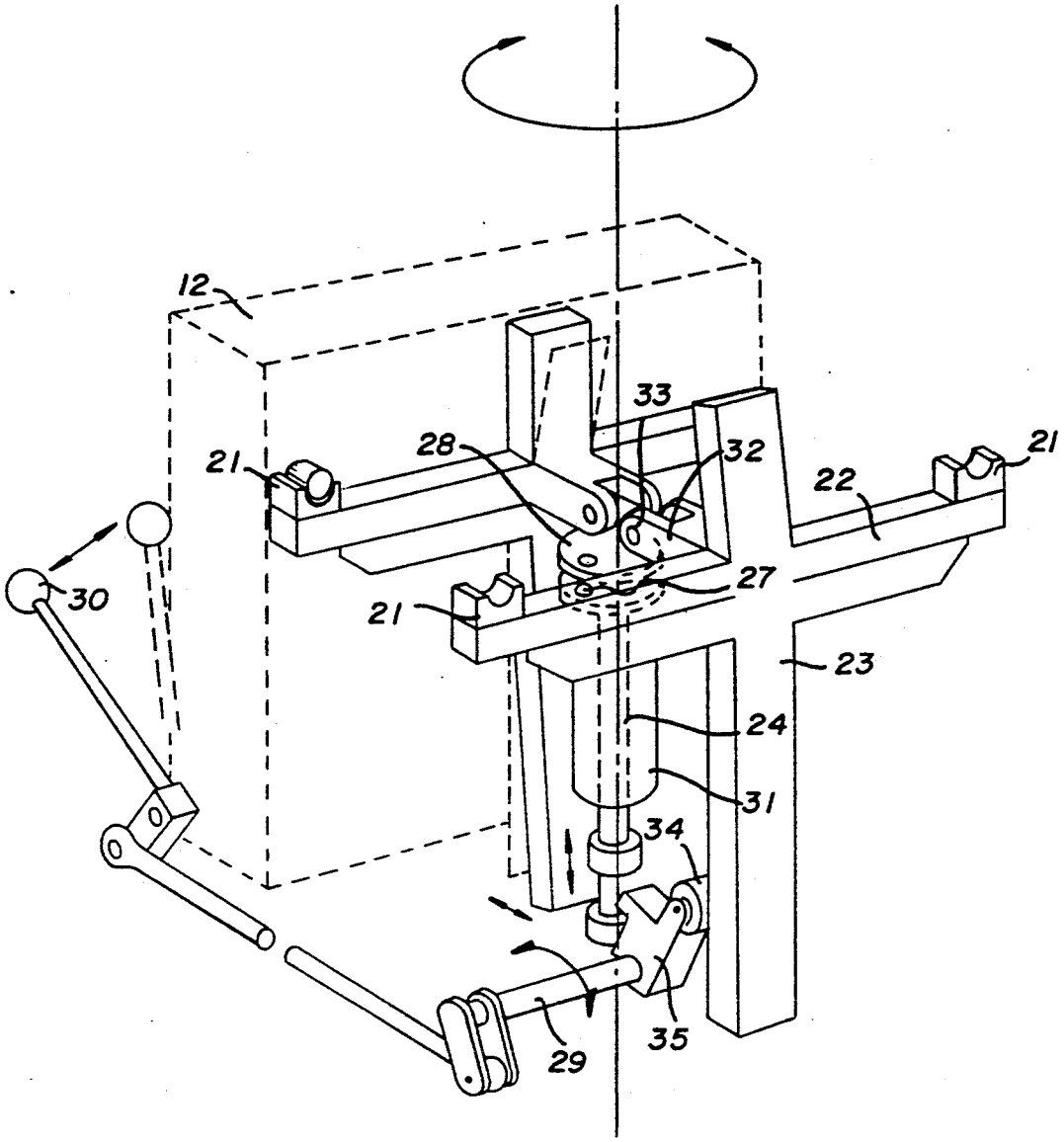

In FIG. 3 the handling magazine is shown with the unit 12 sketched by dotted lines. The handling magazine is shown with the front part in the direction of the traveling path of the mold sections turning out of the plane of the paper.

The unit 12 is at its rear side provided with studs resting in projections 21 with complementarily shaped recesses. The projections 21 are placed at the ends of one bar 22 of a cross consisting of two bars 22 and 23, forming the support for unit 12. The cross 22,23 is supported so that it can be swivelled on a frame which is generally designated by the reference FIG. 24, and which in the embodiment shown is designed to move forwards and backwards in the longitudinal direction of the mold sections along the side of the molding machine 1. The frame 24 is designed to slide on a rail fastened to the machine 1, and is also supported by a floor rail. The frame 24 is moved forwards and backwards by means of the handle 26 (FIG. 1) firmly fastened to the frame 24.

The cross 22,23 can swivel around an axis parallel to the longitudinal axis of the bar 23 after a locking pin 27 has been drawn out of a recess in the disk 28 fastened to the arm 23. The locking pin has been designed to move up and down (FIG. 3) by moving a spindle 29, which at one end is provided with a handle 30, and which at its opposite end has an excentric device 35, which transmits the turning movement of spindle 29 to a translational shift of the pin 27, which is held in a guide 31. When the pin 27 has been withdrawn from the locking position, the cross 22,23 can be turned manually for example to a position turned 180°.

FIG. 3 shows that the cross 22,23 can be turned between an upper and a lower position, namely the position sketched with dotted lines in the left side of the illustration, and the position shown in solid lines. In this way the cross 22,23 is fastened to the frame 24 via a rearwards extending arm 32, which is hinged to the frame at a bearing 33. The swinging is effected by means of a roller 34, which is fastened to the spindle 29 and therefore designed to press against the lower part of the bar 23 of the cross by turning the spindle 29 by means of the handle 30.

FIG. 3 shows that the handle 30 is used for activation of both the roller 34 and the excentric device 35 via the spindle 29 by turning the handle to the extreme position shown in dotted lines.

The mode of operation of the handling magazine is explained in the following by the sequence shown in FIG. 4.

Figure 4A:
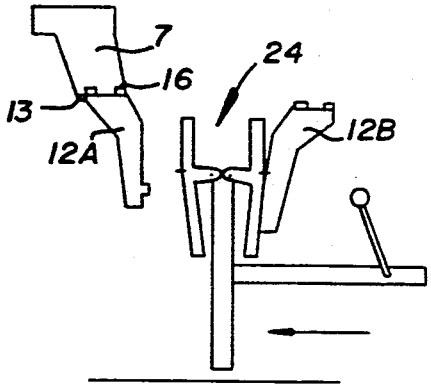

In FIG. 4*a* the handling apparatus 24 is moving towards the core setting apparatus, which at the bottom is provided with a unit 12A consisting of rear plate and core mask. The unit 12A hangs on the core setter 7 by the sketched coupling lugs 16,13. In the handling apparatus hangs a finished unit 12B.

Figure 4B:
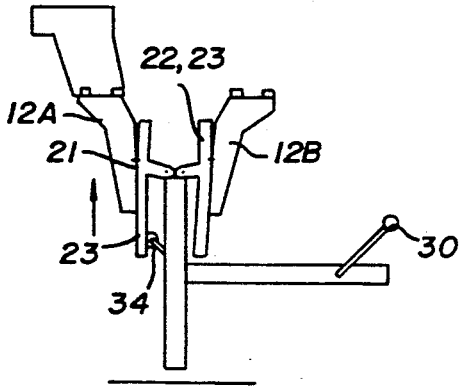

In FIG. 4*b* the cross 22,23 has been raised by a turning the handle 30 and the action of the pressure of the roller 34 against the bar 23. The projections 21 have hereby been made to engage the studs on the rear side of the unit 12A. The unit 12A therefore hangs on the projections 21, and the coupling lugs 16,13 are not in engagement with each other.

Figure 4C:
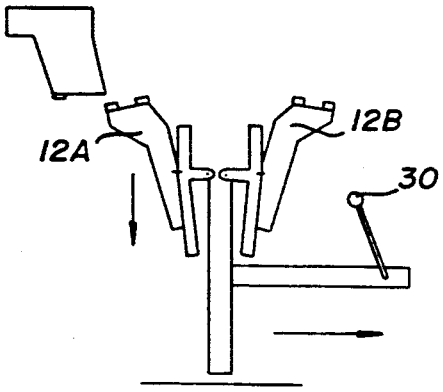

In FIG. 4*c* the handle 30 has been moved back to its initial position, whereby the roller 34 is removed from the bar 23 of the cross, and the unit 12A has been lowered to its lower position.

Figure 4D:
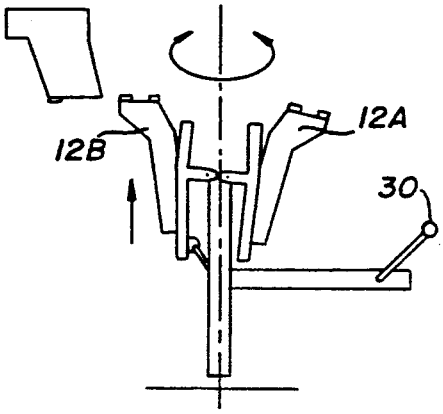

In FIG. 4*d* the cross 22,23 is disengaged and moved through 180° as previously described in the explanation of FIG. 3. The unit designated 12B is raised by activation of handle 30 via the pressure from roller 34 against bar 23.

Figure 4E:
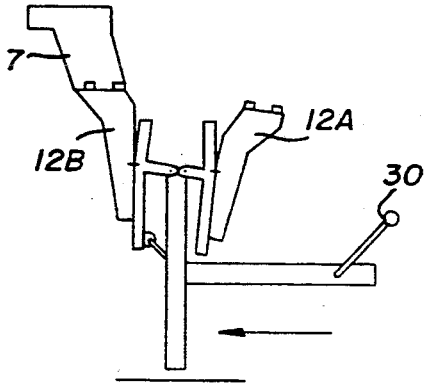

In FIG. 4*e* the handling magazine is pushed into the core setter 7, and the coupling lugs are brought in line above each other.

Figure 4F:
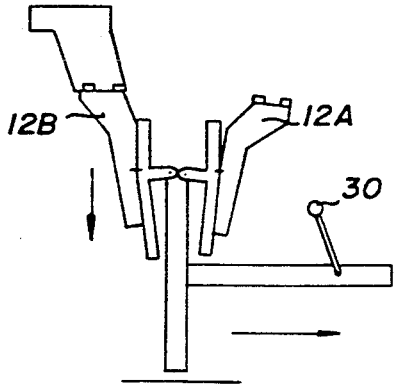

In FIG. 4*f* the unit 12B is lowered by returning the handle 30, whereby the roller 34 is removed from its contact with the bar 23. The projections 21 are thereby disengaged from the unit 12B, and the handling magazine is then moved away from the core setter to the position shown in FIG. 4*a*, thereby finishing the sequence.

What is claimed is:

1. A procedure for changing core masks at a core setting apparatus for an automatic molding system, where the core setting apparatus moves a core placed in a core masks into a mold impression between two mold sections conveyed on a conveyor, said procedure comprising the steps of:

mounting at least one core mask onto at least one respective rear plate, storing the at least one rear plate in a storage magazine near an automatic molding apparatus, transferring a selected rear plate onto the core setting apparatus, mounting a core onto the core mask of the selected rear plate by establishing a vacuum pressure between the core mask and the core, moving the selected rear plate by use of the core setting apparatus to a position where the mounted cover is placed between two consecutive mold sections on the conveyor, releasing the core from the core mask of the selected rear plate by deactivating the vacuum pressure, whereby the core is deposited between the consecutive mold sections, repeating the steps of mounting a core to the core mask of the selected rear plate, moving the selected rear plate to the conveyor, and releasing the core to deposit the core between consecutive mold sections for required number of mold sections, and returning the rear plate by use of the core setting apparatus to the storage magazine whereby a different core mask and rear plate can then be transferred.

2. An automatic molding apparatus for providing a series of consecutive mold sections with molding cores placed between the mold sections, said apparatus comprising:

a conveyor for conveying a series of consecutive mold sections along a path, a unit comprising a core mask mounted to a rear plate, for holding a core to be placed between two of the consecutive molds sections, a core setting apparatus for releasably holding the unit, for moving the unit to a position along the path between the two consecutive mold sections and for placing the core between the two consecutive mold sections, the core setting apparatus being capable of movement both parallel to the path and in a plane perpendicular to the path, controllable vacuum pressure means connected through the core setting apparatus to the core mask of the releasable unit for providing a vacuum pressure within the core mask for holding a core against the core mask until the core is positioned between the two consecutive mold sections.

3. The apparatus of claim 2, wherein the rear plate includes contact lugs for engaging with corresponding contact lugs on the core setting apparatus.

4. The apparatus of claim 2, wherein the core setting apparatus includes at least one locking stud with a conical point for engaging a complementarily shaped conical hole in the rear plate.

5. The apparatus of claim 2 further comprising a magazine for storing the unit, wherein the magazine includes at least two retaining devices each capable of holding the rear plate by engaging locking studs on a rear side of the rear plate, the retaining devices being freely rotatable around a substantially vertical axis is held by one of the retaining devices.

6. The apparatus according to claim 5, wherein the magazine is slidingly suspended for accurate movement forwards and backwards in a direction parallel with the conveyor and towards and away from the core setting system.

7. The apparatus according to claim 6, wherein the magazine is suspended on a guide rail fastened to a side of the conveyor, the rail being suspended parallel to the direction of movement of mold sections on the conveyor.

8. The apparatus according to claim 5, wherein the retaining devices are movable via a lever mechanism between an upper and a lower position, with the contact plates of the rear plate being placed in a plane respectively just above and below the plane defined by the contact plates of the core setting system.

9. The apparatus according to claim 8, wherein the retaining devices are connected with a yoke, the yoke including a collar mounted to a disengagable locking pawl, the yoke being freely turnable around a vertical axis when said locking pawl is disengaged.

10. The apparatus according to claim 5, wherein the restraining devices and the locking pawl are coupled to the control lever, whereby the movements of the restraining devices and locking pawl are activated by movement of the control lever.

* * * * *